US009830794B2

(12) United States Patent
Stowell et al.

(10) Patent No.: US 9,830,794 B2
(45) Date of Patent: Nov. 28, 2017

(54) FIRE SENSOR HAVING A SENSOR GUARD FOR HEAT AND SMOKE DETECTION APPLICATIONS

(71) Applicant: Tyco Fire & Security GmbH, Neuhausen am Rheinfall (CH)

(72) Inventors: John Bradley Stowell, Hollis, NH (US); James T. Roberts, Amherst, NH (US); Donald D. Brighenti, Westminster, MA (US); Alexander S. Andrews, Clinton, MA (US)

(73) Assignee: Tyco Fire & Security GmbH, Neuhausen am Rheinfall ( * ) Notice: Subject to any disclaimer, the term of this patent is extended or adjusted under 35 U.S.C. 154(b) by 0 days.

(21) Appl. No.: 14/728,373

(22) Filed: Jun. 2, 2015

(65) Prior Publication Data

US 2016/0240059 A1 Aug. 18, 2016

Related U.S. Application Data

(60) Provisional application No. 62/116,004, filed on Feb. 13, 2015.

(51) Int. Cl.

| | |
|---|---|
| ***G08B 17/113*** | (2006.01) |
| ***G08B 17/06*** | (2006.01) |
| ***G08B 17/10*** | (2006.01) |

(52) U.S. Cl.

CPC ..... *G08B 17/113* (2013.01); *G08B 17/06* (2013.01); *G08B 17/10* (2013.01)

(58) Field of Classification Search

CPC ..... A47J 37/1261; B29C 2049/2497; B29C 47/0019; B29C 7/0028; B29C 47/02; B29C 47/028; B29C 51/02; B29C 51/12; B29C 51/46; B29C 65/02; B29C 66/54; B29C 66/542; B29C 66/543; B29C 66/545

USPC ..... 340/693.6, 691.6, 693.11, 3.1, 3.43, 340/286.05, 289, 815.45, 815.56, 384.6, 340/438, 584

See application file for complete search history.

(56) References Cited

U.S. PATENT DOCUMENTS

| | | | | |
|---|---|---|---|---|
| 5,257,013 | A * | 10/1993 | Lewkowicz | G08B 17/12 250/372 |
| 5,450,066 | A | 9/1995 | Brighenti et al. | |
| D377,460 | S | 1/1997 | Nelson et al. | |
| 7,592,922 | B2 | 9/2009 | La Vigne | |
| 2003/0058116 | A1* | 3/2003 | Mayusumi | G08B 17/06 340/584 |

(Continued)

OTHER PUBLICATIONS

International Search Report and Written Opinion of the International Searching Authority, dated Apr. 25, 2016, from International Application No. PCT/IB2016/050026, filed on Jan. 4, 2016. Thirteen pages.

(Continued)

*Primary Examiner* — Daniel Previl
(74) *Attorney, Agent, or Firm* — HoustonHogle LLP

(57) ABSTRACT

A sensor guard and method of using the sensor guard to protect a sensor element of a fire sensor. The sensor guard includes one or more legs that extend in a direction that is oblique to a central axis of the fire sensor. The fire sensor includes a housing and the sensor element, extending from the housing, for detecting an indication of fire. The sensor guard is mounted on the housing for protecting the sensor element.

24 Claims, 6 Drawing Sheets

(56) References Cited

U.S. PATENT DOCUMENTS

| | | | | |
|---|---|---|---|---|
| 2004/0001006 | A1* | 1/2004 | MacPherson | G08B 17/113<br>340/693.6 |
| 2005/0121085 | A1* | 6/2005 | Levey | B60K 15/04<br>137/592 |
| 2006/0087418 | A1* | 4/2006 | Takeuchi | B60J 5/06<br>340/438 |
| 2011/0211614 | A1* | 9/2011 | Gmelin | G01K 1/14<br>374/208 |

OTHER PUBLICATIONS

"Simplex: Electronic Heat Detectors for Two-Wire and Four-Wire Bases." Tyco Safety Products Westminster. Westminster, MA, 2008. 4 pages.

* cited by examiner

FIRE SENSOR HAVING A SENSOR GUARD FOR HEAT AND SMOKE DETECTION APPLICATIONS

RELATED APPLICATIONS

This application claims the benefit under 35 U.S.C. §119(e) of U.S. Provisional Application Ser. No. 62/116,004, filed on Feb. 13, 2015, which is incorporated herein by reference in its entirety.

BACKGROUND OF THE INVENTION

Early fire detection is important to the safety of occupants in a building. In particular, fire detection allows for building occupants to evacuate the building and first responders to be summoned.

Fire sensors are installed in buildings to provide fire detection. Fire sensors can be installed as standalone devices. Alternatively, fire sensors can be part of an emergency system, which includes a control panel and a data network that connects the control panel to the fire sensors.

One type of fire sensor is a heat fire sensor which detects fire by measuring the ambient temperature. Heat fire sensors can trigger an alarm when the ambient temperature exceeds a threshold temperature and/or when the rate of temperature rise is indicative of fire.

Heat fire sensors comprise a number of components. Their electronics are typically located within a housing. A sensor element, such as a thermistor sensor element or other temperature sensor element, usually projects from the housing. Finally, a sensor guard is often used to protect the sensor element from mechanical impact.

Another type of fire sensor is a smoke fire sensor that detects fire by measuring smoke. Two common technologies for measuring smoke are optical detection and ionization detection.

Both ionization and optical smoke fire sensors comprise a number of components. Both types of fire sensors include housings. Ionization smoke fire sensors include an ionization chamber sensor element in which the smoke is measured, whereas optical smoke fire sensors have an optical chamber sensor element. In both sensors, a sensor guard is often used to protect the chamber sensor elements from mechanical impact.

SUMMARY OF THE INVENTION

The sensor elements of fire sensors need to be in communication with the ambient environment. Air needs to flow into the chamber sensor elements in the case of smoke fire sensors. The thermistor sensor elements of heat fire sensors need to be sensitive to changes in ambient temperatures.

The sensor guards need to protect sensor elements from being damaged by foreign objects in the ambient environment yet not undermine their communication with the ambient environment. Thus, their designs need to optimize these two competing requirements.

The present invention sensor guard is designed to improve the airflow to the sensor element while still providing protection against mechanical impact. The present invention sensor guard permits airflow around the sensor element to allow the sensor element to detect environmental changes (e.g., ambient temperature changes) with minimal time delay.

In general, according to one aspect, the invention features a sensor guard for protecting a sensor element of a fire sensor. The sensor guard includes one or more legs that extend in a direction that is oblique to a central axis of the fire sensor. The legs funnel and re-direct airflow towards the sensor element. This results in improved airflow near the sensor element.

In general, according to another aspect, the invention features a fire sensor having a housing. The fire sensor includes a sensor element, extending from the housing, for detecting an indication of fire. The fire sensor has a sensor guard, mounted on the housing, for protecting the sensor element. The sensor guard comprises one or more legs that extend in a direction that is oblique to a central axis of the housing.

In embodiments, the legs converge toward each other moving along the central axis away from the housing. Each of the legs is preferably arcuate when viewed along the central axis. Each of the legs can trace a helical path, more particularly a conical helical path, and more particularly a frusto conical helical path. Each of the legs can trace a spiral shape when viewed along the central axis. The one or more legs preferably comprise six legs.

Typically, the sensor guard includes a guard ring. Each of the legs terminate at the guard ring. In particular, each of the legs terminate at the guard ring forming an acute angle between each of the legs and the guard ring. The acute angle is between about 35 degrees and about 55 degrees. The guard ring can have an annular shape.

Typically, the sensor guard includes a guard base. Each of the legs extend from the guard base forming an acute angle between each of the legs and the guard base. The acute angle is between about 10 degrees and about 30 degrees.

The sensor guard has a height defining an area of the sensor guard exposed to horizontal airflow. This height is between about 1.3 centimeters (0.5 inch) and about 2.5 centimeters (1 inch).

Preferably, the sensor element projects from the housing into a volumetric region defined by the legs of the sensor guard. The sensor element can be a thermistor sensor element or a chamber sensor element.

The sensor guard can include bosses for mounting the sensor guard on the housing.

In general, according to another aspect, the invention features a method for protecting a sensor element of a fire sensor. The method includes configuring the fire sensor with the sensor element extending from a housing of the fire sensor. A sensor guard protects the sensor element. The sensor guard has one or more legs that extend in a direction that is oblique to a central axis of the housing. The sensor element can detect an indication of fire based on heat or smoke.

The legs direct airflow towards the sensor element and reduce airflow deflection towards the sensor element. Further, the legs minimize a drag force (e.g., material interference) surrounding the sensor element.

The above and other features of the invention including various novel details of construction and combinations of parts, and other advantages, will now be more particularly described with reference to the accompanying drawings and pointed out in the claims. It will be understood that the particular method and device embodying the invention are shown by way of illustration and not as a limitation of the invention. The principles and features of this invention may be employed in various and numerous embodiments without departing from the scope of the invention.

BRIEF DESCRIPTION OF THE DRAWINGS

In the accompanying drawings, reference characters refer to the same parts throughout the different views. The drawings are not necessarily to scale; emphasis has instead been placed upon illustrating the principles of the invention. Of the drawings.

DETAILED DESCRIPTION OF THE PREFERRED EMBODIMENTS

The invention now will be described more fully hereinafter with reference to the accompanying drawings, in which illustrative embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

As used herein, the term "and/or" includes any and all combinations of one or more of the associated listed items. Further, the singular forms and the articles "a", "an" and "the" are intended to include the plural forms as well, unless expressly stated otherwise. It will be further understood that the terms: includes, comprises, including and/or comprising, when used in this specification, specify the presence of stated features and/or components, but do not preclude the presence or addition of one or more other features components, and/or groups thereof. Further, it will be understood that when an element, including component or subsystem, is referred to and/or shown as being connected or coupled to another element, it can be directly connected or coupled to the other element or intervening elements may be present.

Figure 1:
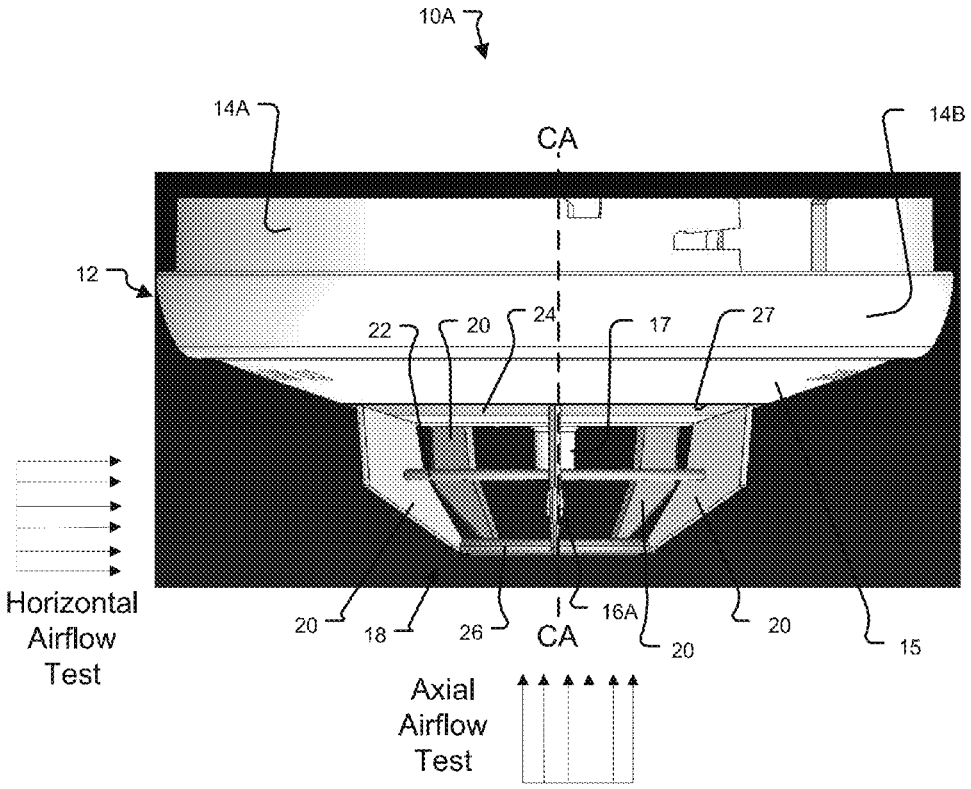
PRIOR ART FIG. 1
FIG. 1 is a side view of a prior art heat fire sensor.

FIG. 1 illustrates a prior art heat fire sensor 10A that comprises a housing 12, a heat sensor element 16A extending from the housing 12, and a sensor guard 18 mounted on the housing 12 for protecting the heat sensor element 16A from mechanical impact.

The housing 12 has a number of parts. The parts include a housing base 14A that is generally cylindrically shaped and typically mates with a ceiling-installed mounting base. A housing shoulder 14B is somewhat cylindrical to conical and terminates in a proximal housing surface 15. The proximal housing surface 15 curves inward towards a central axis CA of the heat fire sensor 10A. The housing 12 and its related parts can be made of a single molded piece of plastic. For example, the housing 12 can be made by an injection molding process in which powdered plastic and molding pigments are mixed, heated, and forced into a mold under pressure and then cooled to form the housing 12.

The prior art sensor guard 18 is mounted to the proximal housing surface 15. In particular, the proximal housing surface 15 has an annular groove 27 for accepting a guard base 24 of the sensor guard 18.

The housing 12 functions to protect the inner electronics of the heat fire sensor 10A. The inner electronics often includes a printed circuit board (PCB) with a controller, wired and/or wireless communication interfaces, main battery, and/or backup battery, for example.

The heat sensor element 16A extends downward from the housing 12, usually along the central axis CA of the heat fire sensor 10A. In more detail, the heat sensor element 16A is mounted to a sensor base 17 which projects away from the proximal housing surface 15.

The heat sensor element 16A functions to detect an ambient temperature. In implementations, the heat sensor element 16A is a thermistor sensor element, thermocouple sensor element, or other temperature sensor element that is responsive to changes in the ambient temperature. Thus, the prior art heat fire sensor 10A can use these responses to detect when the ambient temperature exceeds a threshold temperature or the rate of temperature rise, indicating fire.

Fire sensors are typically installed on walls or ceilings of buildings. This enables the heat sensor element 16A to be in communication with the ambient environment. Since heat generated by fire tends to rise towards the ceiling, the fire sensors are preferably mounted to the ceiling.

The illustrated prior art sensor guard 18 comprises vertical legs 20, a horizontal annular rib 22, the guard base 24, and a guard ring 26. In particular, the prior art sensor guard 18 has five vertical legs 20 that extend between the guard base 24 and the guard ring 26. The five vertical legs 20 are interconnected by the horizontal annular rib 22 that runs along the inner sides of the legs 20.

Each vertical leg 20 has a general vane shape in a plane that extends through the leg and the central axis CA. In particular, each vertical leg 20 has a vane shape with a width, in the radial direction with respect to the central axis CA. This width is greatest near the guard base 24 and then generally decreases moving in the direction of the central axis CA away from the guard base 24.

Figure 2:
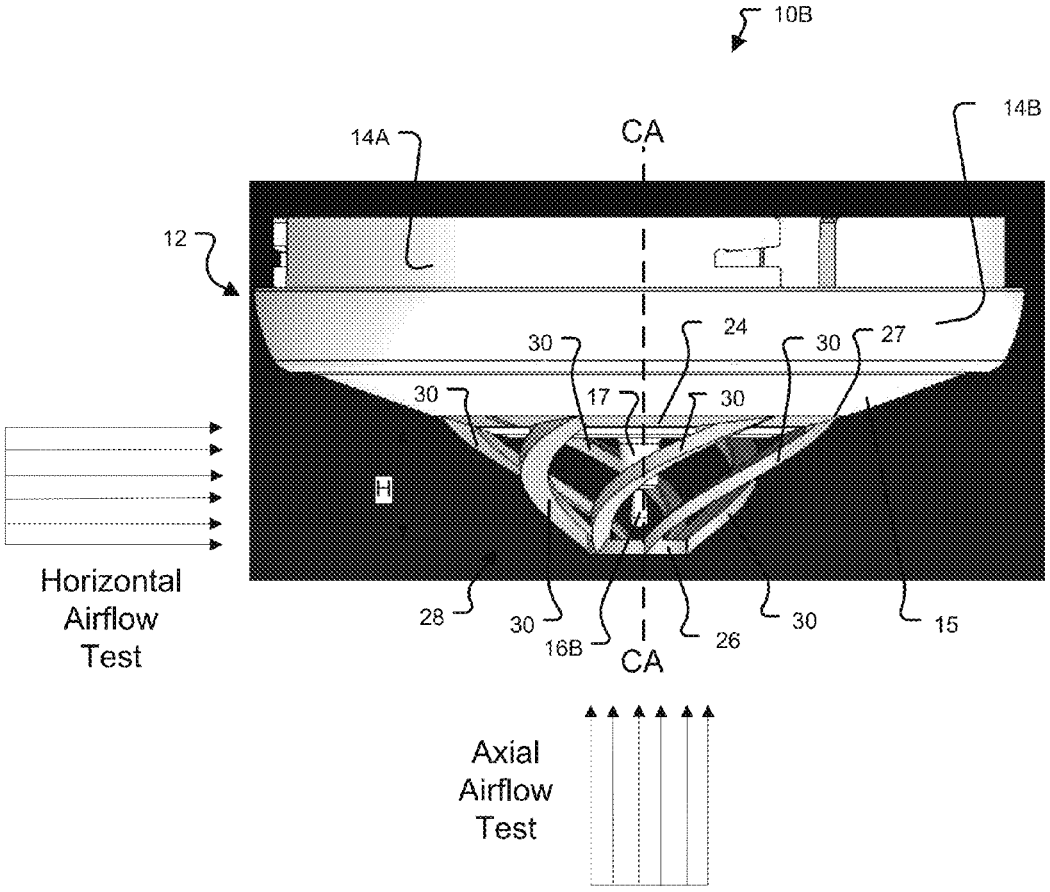
FIG. 2 is a side view of a fire sensor including a sensor guard according to an embodiment of the present invention.

FIG. 2 shows a fire sensor 10B having a sensor guard 28 that that has been constructed according to the principles of the present invention. The present invention sensor guard 28 provides improved airflow compared to the prior art sensor guard 18 while still providing protection from mechanical impact. In particular, the sensor guard 28 is designed to improve airflow by funneling/re-directing airflow to a sensor element 16B.

The fire sensor 10B is either a heat fire sensor or smoke fire sensor generally having the same components as the prior art heat fire sensor 10A. The components include the housing 12 having the housing base 14A, housing shoulder 14B, and proximal housing surface 15 for protecting inner electronics. The components also include the sensor element 16B extending from the housing 12 and the present invention sensor guard 18 mounted on the housing 12 for protecting the sensor element 16B. Similar to the prior art heat fire sensor 10A, the annular groove 27 of the proximal housing surface 15 accepts a guard base 24 of the present invention sensor guard 28.

The sensor element 16B can either be a heat sensor element or a chamber sensor element. In the illustrated example, the sensor element 16B is the heat sensor element particularly the thermistor sensor element as described above. Alternatively, the sensor element 16B can be a chamber sensor element such as an ionization chamber sensor element or optical chamber sensor element used to measure smoke. As described above, the sensor element 16B is mounted to the sensor base 17 projecting away from the housing 12.

The sensor guard 28 includes six legs 30 extending between a guard base 24 and a guard ring 26. As illustrated, the guard base 24 and the guard ring 26 have an annular shape. The sensor element 16B projects from the housing 12 into a volumetric region defined by the legs 30, guard base 24, and guard ring 26.

FIGS. 2, 3, and 5A-5D are different views (e.g., side, top, bottom, and perspective) of the inventive sensor guard 28 mounted to the housing 12 of the fire sensor 10B (FIGS. 2 and 3) as well as by itself prior to installation (FIGS. 5A-5D). These views illustrate an improved design for the sensor guard 28. This improved design particularly relates to the arrangement of the legs 30 and shape of each leg 30.

The legs 30 are arranged to improve airflow near the sensor element 16B. The legs 30 are arranged to extend in a direction that is oblique to the central axis CA of the housing 12. The legs 30 converge toward each other moving along the central axis CA away from the housing 12. The legs 30 can trace a helical path and more particularly a conical helical path. In the illustrated embodiment, the legs 30 trace a frusto conical helical path. This arrangement of the legs 30 spreads out the leg material laterally (FIG. 2) instead of concentrating the leg material vertically (FIG. 1). This allows for better airflow running across the sensor element 16B and decreases the area of airflow deflection surrounding the sensor element 16B.

One international standard examines a fire sensor with respect to "worst case orientation" which is defined as the angle at which a fire sensor is most obstructed and/or provides the highest time response to environment change such as changing ambient temperature. The arrangement of the legs 30 eliminates concentrated airflow obstacles. When compared to the prior art sensor guard 18, the present invention sensor guard 28 has less area of leg material blocking the sensor element 16B. Thus, the present invention sensor guard 28 provides an improvement with respect to the "worst case orientation" international standard.

Figure 3:
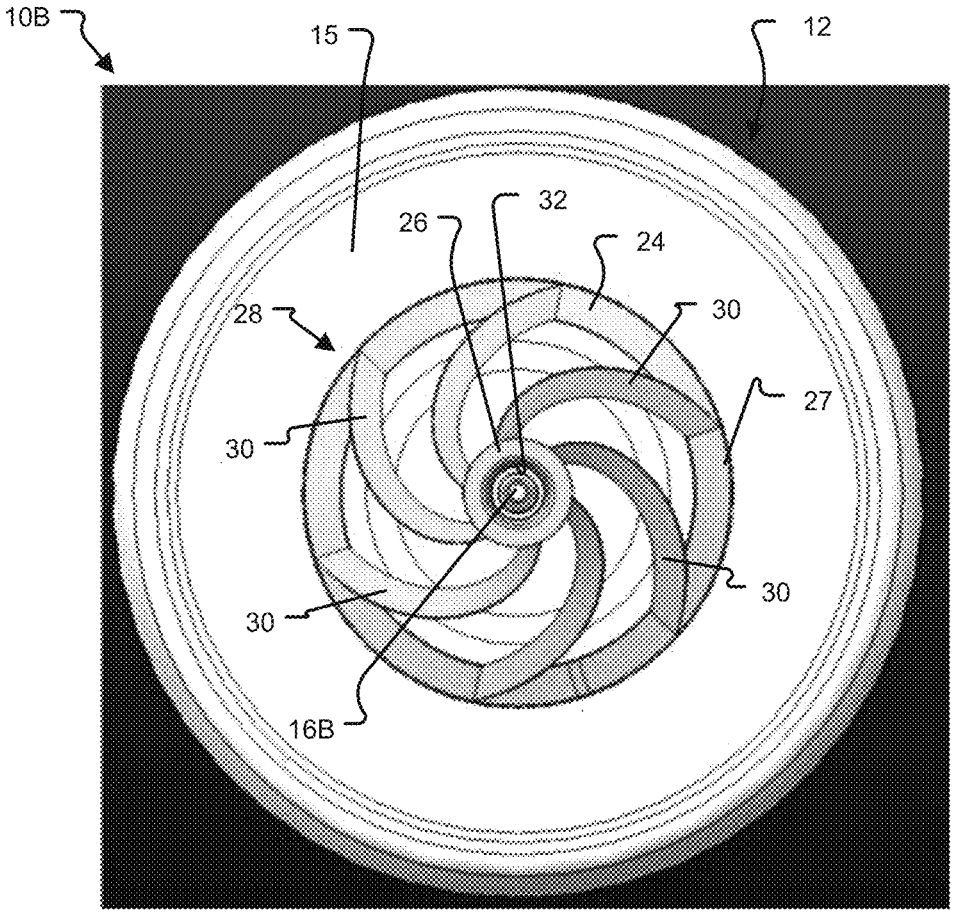
FIG. 3 is a bottom view of the fire sensor of FIG. 2.
Figure 5A:
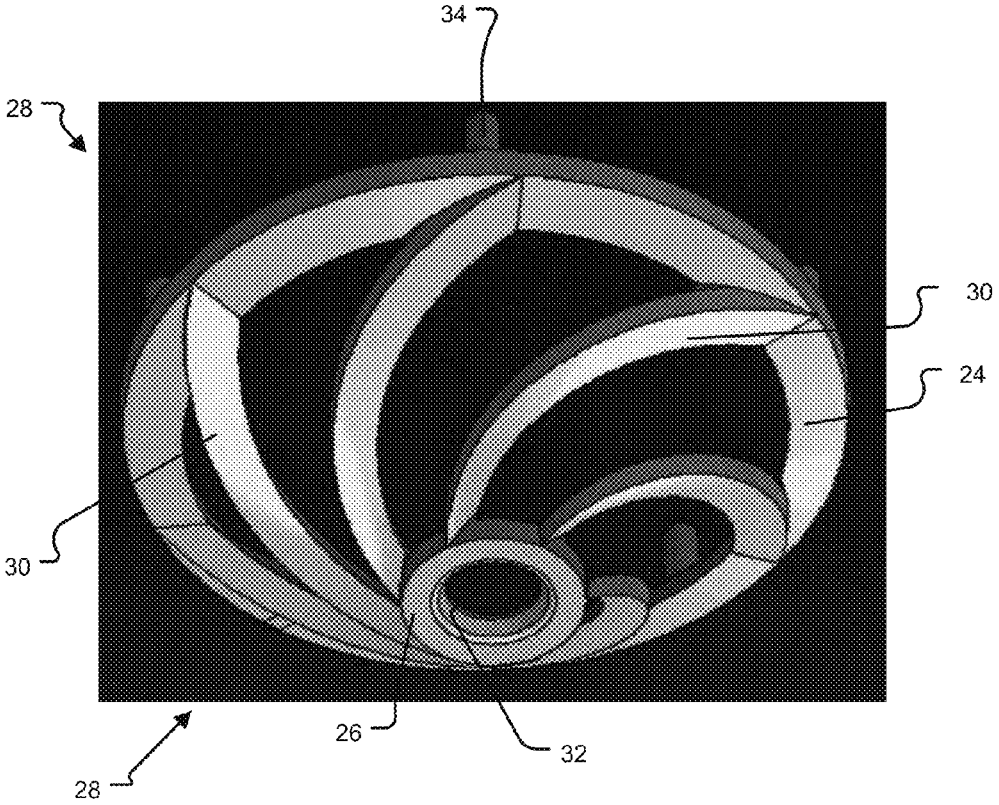
FIG. 5A is a perspective view of the sensor guard of FIG. 2.
Figure 5B:
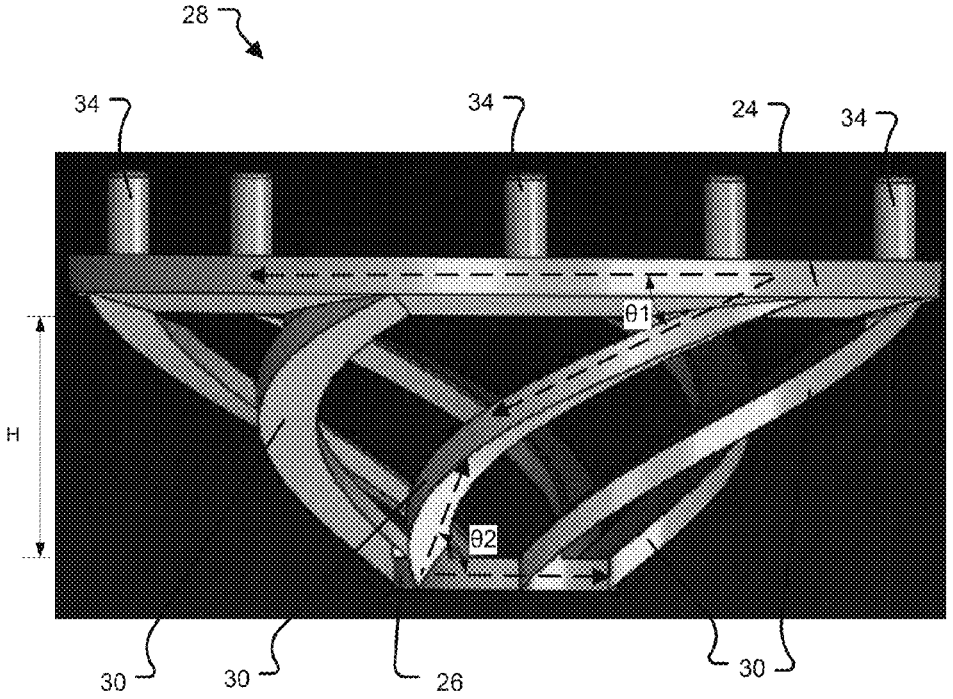
FIG. 5B is a side view of the sensor guard of FIG. 2.
Figure 5C:
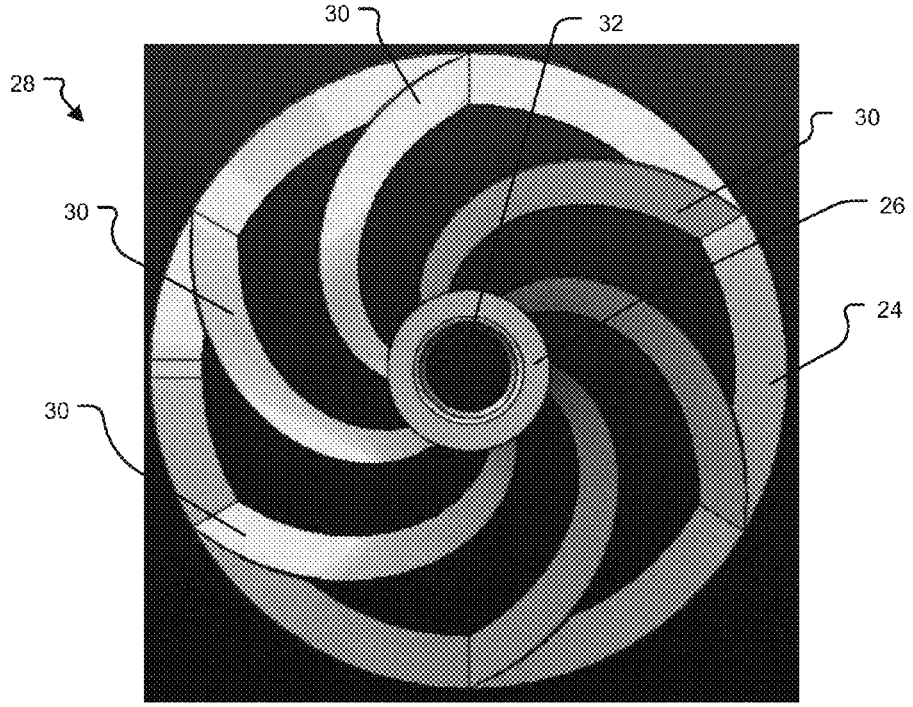
FIG. 5C is a bottom view of the sensor guard of FIG. 2.
Figure 5D:
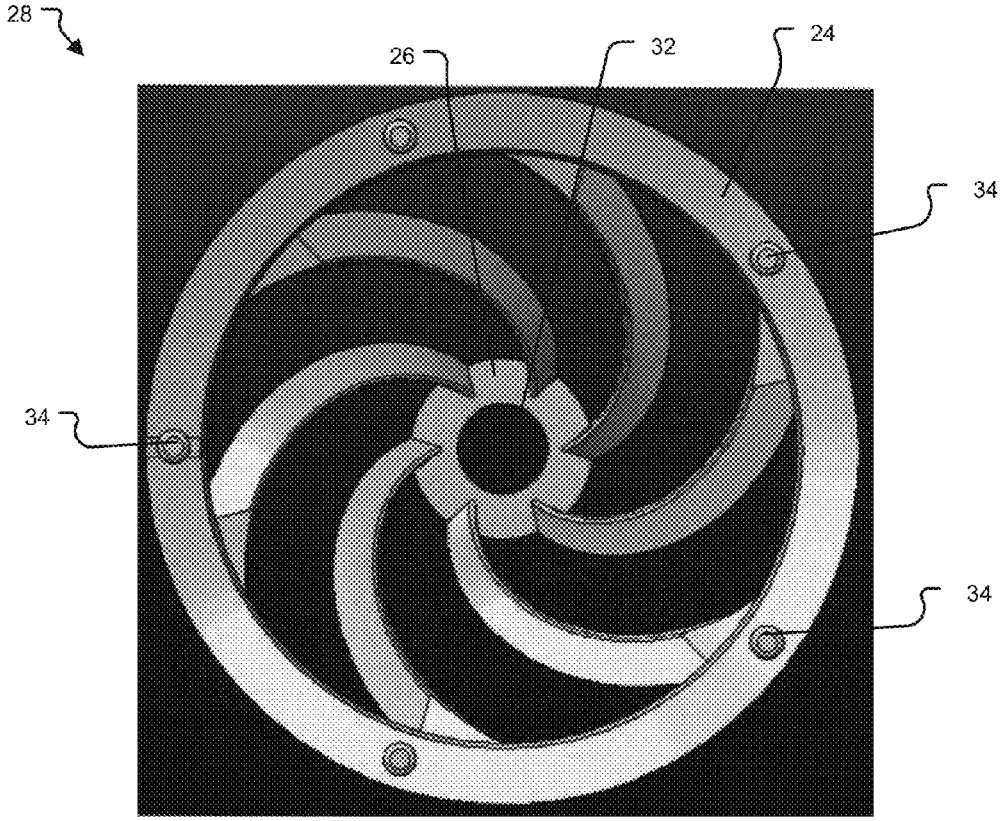
FIG. 5D is a top view of the sensor guard of FIG. 2.

As shown in FIGS. 3, 5C, and 5D, each of the legs 30 trace a spiral shape when viewed along the central axis CA. The legs 30 of the sensor guard 28 particularly trace the spiral up a height H of the sensor guard 28 from the guard base 24 to the guard ring 26. This height H relates to an area of the sensor guard 28 exposed to airflow (e.g., horizontal airflow). The height H is between about 1.3 centimeters (0.5 inch) and about 2.5 centimeters (1 inch), for example. The spiral shape of the legs 30 up to the guard ring 26 provides minimal leg material in the legs 30 that could negatively deflect air away from the sensor element 16B. This spiral shape improves the amount of airflow capable of reaching the sensor element 16B when airflow is directed at the sensor guard 28. In an example, each leg 30 has a pitch angle between about 1.5 degrees and about 4 degrees with respect to the spiral shape. In particular, each leg 30 has a pitch angle of about 2.75 degrees.

As illustrated in FIG. 3, the guard ring 26 has a main hole 32 for further enhancing airflow to the senor element 16B. This main hole 32 is aligned with the sensor element 16B allowing airflow to be directed by the main hole 32 towards the sensor element 16B. The combination of the main hole 32 with the legs 30 being tapered into the center (i.e., legs tracing the spiral shape) induces and pulls airflow inwards and towards a head portion of the sensor element 16B.

As illustrated in FIG. 5B, each of the legs 30 form an acute angle θ1, θ2 with the guard base 24 and the guard ring 26, respectively. In particular, each leg 30 extends from the guard base 24 forming the acute angle θ1 between the leg 30 and the guard base 24. This acute angle θ1 is between about 10 degrees and about 30 degrees. For the guard ring 26, each of the legs 30 terminate at the guard ring 26 forming the acute angle θ2 between each leg 30 and the guard ring 26. This acute angle θ2 is between about 35 degrees and about 55 degrees.

As illustrated in FIGS. 5A, 5B, and 5D, the sensor guard 28 can include bosses 34 as part of the guard base 24. The bosses 34 are used for mounting the sensor guard 28 into the annular groove 27 of the proximal housing surface 15.

Figure 4:
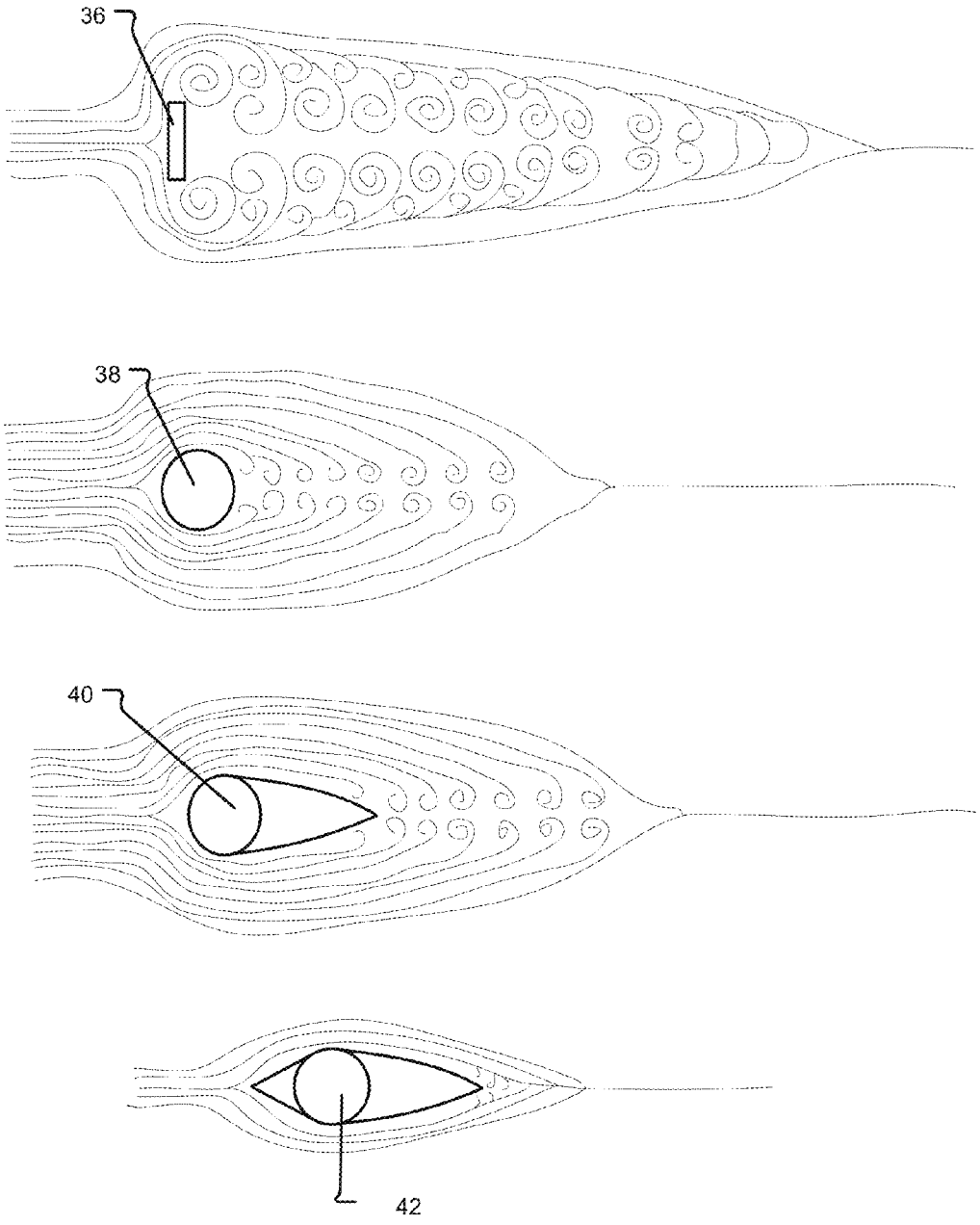
FIG. 4 is a diagram of different shapes and their corresponding aerodynamic performance.

The airflow or cross-sectional profile for each leg 30 is also important to improving airflow near the sensor element 16B based on aerodynamic theory. Aerodynamic theory states that a shape with a sharper leading edge and tapered body provides a more laminar airflow than a shape with a thick leading edge and minimally tapered body. As illustrated in FIG. 4, the airflow profile improves for shapes ranked in the following order from least aerodynamic to most aerodynamic: flat plate 36 to circle 38, circle 38 to circle with fairing 40, and then circle with fairing 40 to wing-shaped housing 42. Based on FIG. 4, it was determined that a leg shape providing minimal airflow distortion allows less turbulent airflow to reach the sensor element 16B, which in turn helps provide improved fire detection accuracy and speed.

Each of the legs 30 of the sensor guard 28 preferably has an aerodynamic cross-sectional profile. In particular, FIGS. 2 and 5B illustrate the legs 30 having a generally blade shaped geometry as the legs 30 spiral up to the guard ring 26. The cross-sectional profile is generally constant along the length of each leg. As shown in FIG. 3, each of the legs 30 is preferably arcuate when viewed along the central axis CA. Each leg 30 has a cross-sectional profile designed to incorporate a sharp leading edge with a tapered body. This cross-sectional profile helps delay the point of air separation from the profile of the leg 30 which in turn helps reduce airflow distortion and induced turbulence. In one example, the cross-sectional profile has a generally parallelogram shape. However, in other embodiments, legs having a circle with fairing profile 40 or wing-shaped profile 42 are used.

To quantify the improvements of the helical guard (i.e., present invention sensor guard 28) compared with the current guard (i.e., prior art sensor guard 18), the two following tests were conducted: horizontal airflow test and axial airflow test. These two tests were chosen to most closely replicate international standard tests that are conducted in both China and Korea. The direction of airflows used during the horizontal airflow test and the axial airflow test are illustrated in FIGS. 1 and 2.

The horizontal airflow test was conducted by increasing air temperature at a constant horizontal airflow rate across each respective sensor guard 18, 28 towards the respective sensor element 16A, 16B. Each fire sensor 10A, 10B was initially tested at various orientations with an airflow temperature rate of rise of 10° C./minute to determine the position of minimum and maximum response time (i.e., orientation settings). Once these orientation settings were determined, the fire sensor 10A, 10B was tested at a rate of rise of 5° C./minute. Oven temperatures were recorded when the fire sensor 10A, 10B alarm was generated at the best case orientation and worst case orientation.

Table 1 shows a summary and comparison of oven temperatures when alarms were generated during testing of the prior art sensor guard 18 against the present invention sensor guard 28. In particular, Table 1 shows oven temperatures required to instigate an alarm for each fire sensor 10A, 10B at best and worst case orientations. For the prior art sensor guard 18, these orientations were 44 degrees and 89 degrees. For the present invention sensor guard 28, these orientations were 88 degrees and 43 degrees.

Table 1 shows the temperature difference between the best and worst case orientations for each fire sensor 10A, 10B. The oven temperature difference for the present invention sensor guard 28 is less than the oven temperature difference for the prior art sensor guard 18:

TABLE 1

Horizontal airflow test results.

| | Oven Temperature at Alarm [deg F.] | Difference [deg F.] |
|---|---|---|
| Current Guard @ 89 deg | 138.7 | 6.1 |
| Current Guard @ 44 deg | 132.6 | |
| Helical Guard @ 88 deg | 131.7 | 2.5 |
| Helical Guard @ 43 deg | 134.2 | |

The results of the horizontal airflow test showed an improved accuracy of detection when using the present invention sensor guard 28 as compared to the prior art sensor guard 18. In particular, oven temperatures at alarm recorded for the prior art sensor guard 18 generally have a higher average temperature than the average temperature of the oven temperatures at alarm for the present invention sensor guard 28. Also, as noted above, the difference between the recorded oven temperatures for best and worst case orientations was higher for the prior art sensor guard 18 compared to present invention sensor guard 28. As shown in Table 1, using the present invention sensor guard 28 lowered oven temperatures at alarm and decreased the oven temperature difference between the worst and best case orientation when compared to using the prior art sensor guard 18. This proves that the present invention sensor guard 28 creates more consistent sensor readings regardless of orientation compared to the prior art sensor guard 18.

The axial airflow test includes providing a constant axial airflow towards each respective sensor guard 18, 28 particularly towards the respective sensor elements 16A, 16B at a constant temperature. For this test, a heat tunnel was brought to a constant temperature with a constant air flow rate while each fire sensor 10A, 10B was positioned outside the tunnel in the ambient environment. Once the tunnel was set at the correct temperature and flow rate, the fire sensor 10A, 10B was plunged into the ambient environment and was positioned at a constant location where the airflow ran directly into the sensor guard 18, 28 as shown in FIGS. 1 and 2. In this axial airflow test, the time response of each fire sensor 10A, 10B was measured at a temperature slightly lower than the tunnel climate. The sensor guards 18, 28 were tested and compared at constant test parameters.

Results of the axial airflow test show an improved speed of detection when using the present invention sensor guard 28 versus the prior art sensor guard 18. There was a particular improvement in sensor response time when using the present invention sensor guard 28 in the axial airflow test. In particular, as shown in Table 2 below, the average sensor response time for the prior art sensor guard 18 was about 49 seconds compared to about 32.2 seconds for the present invention sensor guard 28.

TABLE 2

Axial airflow test results.

| Guard Design | Time to Alarm [sec] | Average [sec] |
|---|---|---|
| Current Guard (1) | 50 | 49 |
| Current Guard (2) | 48 | |
| Current Guard (3) | 49 | |

TABLE 2-continued

Axial airflow test results.

| Guard Design | Time to Alarm [sec] | Average [sec] |
|---|---|---|
| Current Guard (4) | 49 | |
| Current Guard (5) | 49 | |
| Helical Guard (1) | 33 | 32.2 |
| Helical Guard (2) | 32 | |
| Helical Guard (3) | 31 | |
| Helical Guard (4) | 33 | |
| Helical Guard (5) | 32 | |

Based on the results of the horizontal airflow test and the axial airflow test, using the present invention sensor guard 28 design improves fire sensor performance as compared to using the prior art guard 18. Based on the results of these tests, the present invention sensor guard 28 has improved airflow near the sensor element 16B compared to the prior art sensor guard 18.

The present invention sensor guard 28 can be used within a method for protecting the sensor element 16B. In a first step, the fire sensor 10B is configured with the sensor element 16B extending from the housing 12. The sensor guard 28 is employed to protect the sensor element 16B. As described above, the sensor guard 28 has legs 30 extending in the direction that is oblique to the central axis CA of the housing 12. Further, this method includes the legs 30 directing airflow towards the sensor element 16B and reducing airflow deflection. Also, this method includes the legs 30 minimizing a drag force (i.e., material interference) surrounding the sensor element 30.

While this invention has been particularly shown and described with references to preferred embodiments thereof, it will be understood by those skilled in the art that various changes in form and details may be made therein without departing from the scope of the invention encompassed by the appended claims.

What is claimed is:

1. A fire sensor, comprising:

a housing;

a sensor element, extending from the housing, for detecting an indication of fire; and a sensor guard, mounted on the housing, for protecting the sensor element, wherein the sensor guard comprises one or more legs that each trace a helical path extending in a direction of a central axis of the housing.

2. The fire sensor according to claim 1, wherein the one or more legs converge toward each other when moving along the central axis away from the housing.

3. The fire sensor according to claim 1, wherein each of the legs is arcuate when viewed along the central axis.

4. The fire sensor according to claim 1, wherein the sensor guard further comprises a guard ring, each of the legs terminating at the guard ring.

5. The fire sensor according to claim 4, wherein the guard ring has an annular shape.

6. The fire sensor according to claim 1, wherein each of the legs traces a conical helical path.

7. The fire sensor according to claim 1, wherein each of the legs traces a frusto conical helical path.

8. The fire sensor according to claim 1, wherein each of the legs traces a spiral shape when viewed along the central axis.

9. The fire sensor according to claim 1, wherein the sensor guard further comprises a guard base, each of the legs extending from the guard base and forming an acute angle between each of the legs and the guard base, the acute angle being between about 10 degrees and about 30 degrees.

10. The fire sensor according to claim 1, wherein the sensor guard further comprises a guard ring, each of the legs terminating at the guard ring and forming an acute angle between each of the legs and the guard ring, the acute angle being between about 35 degrees and about 55 degrees.

11. The fire sensor according to claim 1, wherein the sensor guard has a height for an area of the sensor guard exposed to horizontal airflow, the height is between about 1.3 centimeters (0.5 inch) and about 2.5 centimeters (1 inch).

12. The fire sensor according to claim 1, wherein the sensor element is a thermistor sensor element or a chamber sensor element.

13. The fire sensor according to claim 1, wherein the sensor element projects from the housing into a volumetric region defined by the legs.

14. The fire sensor according to claim 1, wherein the sensor guard comprises a guard base and a guard ring, wherein the legs extend between the guard base and the guard ring.

15. The fire sensor according to claim 1, wherein the one or more legs comprise six legs.

16. The fire sensor according to claim 1, wherein the sensor guard further comprises bosses for mounting the sensor guard on the housing.

17. A sensor guard for protecting a sensor element of a fire sensor, the sensor guard comprising one or more legs that each trace a helical path extending in a direction of a central axis of the fire sensor.

18. The sensor guard according to claim 17, wherein each of the legs is arcuate when viewed along the central axis.

19. The sensor guard according to claim 17, wherein each of the legs traces a frusto conical helical path.

20. A method for protecting a sensor element of a fire sensor, the method comprising:

configuring the fire sensor with the sensor element extending from a housing of the fire sensor; and protecting the sensor element with a sensor guard comprising one or more legs that each trace a helical path extending in a direction of a central axis of the housing.

21. The method according to claim 20, further comprising the legs directing airflow towards the sensor element.

22. The method according to claim 20, further comprising the sensor element detecting an indication of fire based on heat or smoke.

23. The method according to claim 20, further comprising the legs reducing airflow deflection towards the sensor element.

24. The method according to claim 20, further comprising the legs minimizing a drag force surrounding the sensor element.

* * * * *